United States Patent [19]

Ma

[11] Patent Number: 4,594,972

[45] Date of Patent: Jun. 17, 1986

[54] VALVE MECHANISM

[75] Inventor: Thomas T. Ma, Chelmsford, United Kingdom

[73] Assignee: Ford Motor Company, Dearborn, Mich.

[21] Appl. No.: 793,727

[22] PCT Filed: Feb. 8, 1984

[86] PCT No.: PCT/US84/00172

§ 371 Date: Feb. 8, 1984

§ 102(e) Date: Feb. 8, 1984

[87] PCT Pub. No.: WO84/03331

PCT Pub. Date: Aug. 30, 1984

Related U.S. Application Data

[63] Continuation of Ser. No. 619,142, Feb. 8, 1984, abandoned.

[30] Foreign Application Priority Data

Feb. 22, 1983 [GB] United Kingdom ..... 8304880

[51] Int. Cl.[4] ..... F01L 1/30

[52] U.S. Cl. ..... 123/90.24; 123/90.27

[58] Field of Search ..... 123/90.24, 90.25, 90.26, 123/90.27

[56] References Cited

U.S. PATENT DOCUMENTS

| | | | |
|---|---|---|---|
| 1,227,812 | 5/1917 | MacPherson | 123/90.24 |
| 1,444,857 | 2/1923 | Taub | 123/90.25 X |
| 1,503,384 | 7/1924 | Sewell | 123/90.25 |
| 2,015,135 | 9/1935 | Brady | 123/90.24 X |
| 2,833,258 | 5/1958 | Lorscheidt et al. | 123/90.24 |
| 2,954,017 | 9/1960 | Forstner | 123/90.25 X |

FOREIGN PATENT DOCUMENTS

| | | | |
|---|---|---|---|
| 578429 | 5/1933 | Fed. Rep. of Germany | 123/90.24 |
| 343688 | 2/1931 | United Kingdom | 123/90.24 |

*Primary Examiner*—William R. Cline
*Assistant Examiner*—Peggy Neils
*Attorney, Agent, or Firm*—Robert E. McCollum; Clifford L. Sadler

[57] ABSTRACT

The invention is concerned with a desmodromic valve operating mechanism, i.e. one in which the valve is mechanically closed instead of relying on the action of a spring. The valve operating mechanism comprises a cam 20 driven in synchronism with the engine crankshaft. A cam follower 18 is acted upon by an opening profile 22 of the cam 20 and serves to move the valve 10 in an opening direction. A movable closing member 26 has two profiles 24, 28. The first profile 24 interacts with the cam 20 and the second 28 with the cam follower 18. Closure of the valve is effected by the opening profile 22 of the cam 20 acting on the first cam profile 24 of the closing member 26 to move the closing member 26 in such a direction that the second cam profile 28 of the closing member 26 acts on the cam follower 18 to close the valve 10.

4 Claims, 6 Drawing Figures

VALVE MECHANISM

Figure 1:
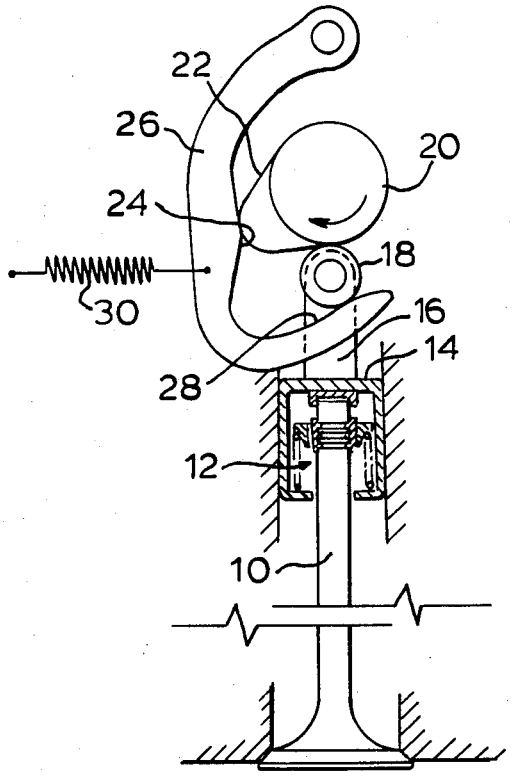

This application is a continuation of application Ser. No. 619,142, filed Feb. 8, 1984, now abandoned.

The present invention relates to a valve mechanism.

In a conventional valve train, a spring is used to return the valve after opening. The spring must be relatively stiff to counteract the inertia of the valve so as to allow the engine to run at a safe maximum design speed without valve bounce. This limits the rate of acceleration of the valve, which it is desirable to increase in order to improve the time lift integral of the valve opening period, that is to say to increase the breathing efficiency of the engine. Higher valve acceleration requires a stiffer spring which increases the stresses and causes excessive wear. Valve train friction is also increased and the torque required to drive the valve train fluctuates widely as the springs are compressed and relaxed.

There have been proposed in the past so called desmodromic valve mechanisms in which the valve is returned by positive mechanical action and does not require the use of a stiff return spring. Such a mechanism therefore has the potential of giving better breathing efficiency at high engine speed, less valve train friction and less fluctuations in the driving torque. However, most known designs are complicated, expensive to implement and require very accurate dimensional control.

The present invention seeks to provide an operating mechanism for a valve in which the closing movement of the valve is effected or else at least assisted by positive cam action but which can be implemented in a less costly and complex manner.

In accordance with the present invention, there is provided a vaive operating mechanism for an internal combustion engine, comprising a cam driven in synchronism with the engine crankshaft, a cam follower acted upon by an opening profile of the cam and operative to move a valve in an opening direction and a movable closing member having two profiles thereon the first interacting with the cam and the second with the cam follower, closure of the valve being effected by the opening profile of the cam acting on the first cam profile of the closing member to move the closing member in such a direction that the second cam profile of the closing member acts on the cam follower to close the valve.

Preferably, the closing member has a generally V-shaped edge of which one side constitutes the first cam profile and the other constitutes the second cam profile. The closing member may either be pivotable or slidable relative to the cam shaft.

Advantageously, a light spring is provided to move the closing member in a direction to close the valve but this spring need not be very stiff and serves merely to support the weight of the valve and to take up the small tolerances when the valve is nearly closed.

It is possible for the cam follower to consist of a roller mounted directly in line with the valve stem. Alternatively, the cam follower may comprise an intermediate member, such as a pivoted lever, having a first cam surface engageable by the cam and carrying a roller acting as a follower for the second cam profile of the closing member. The valve in the latter case may either be coupled to an extension of the lever or may be mounted directly in line with the roller.

Figure 2:
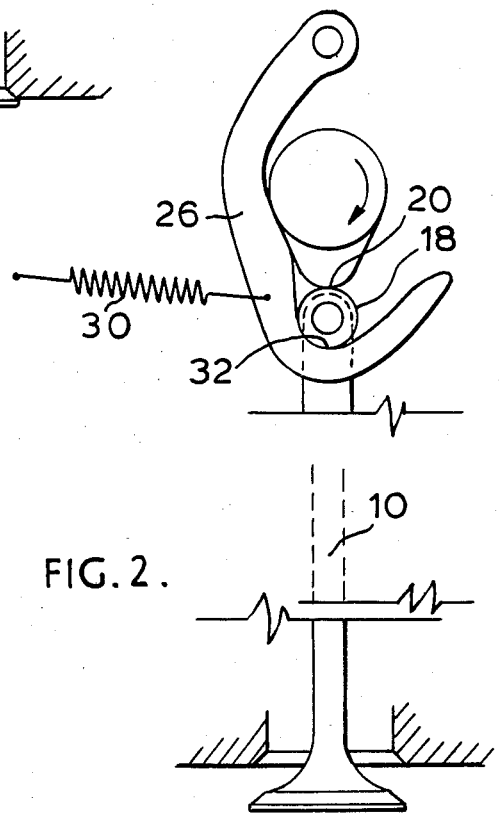
Figure 3:
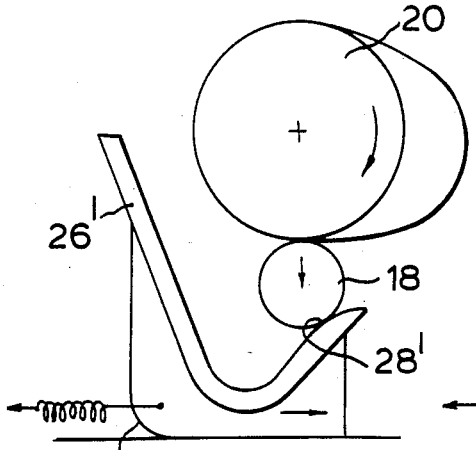
Figure 4:
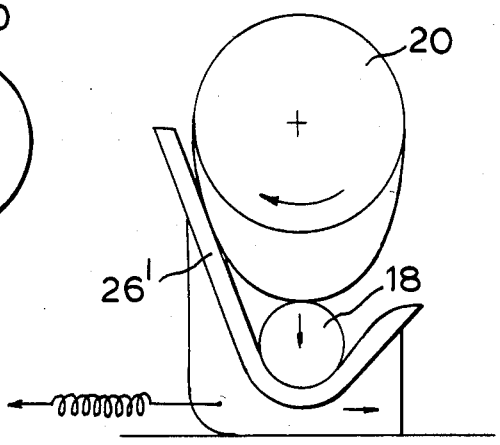
Figure 5:
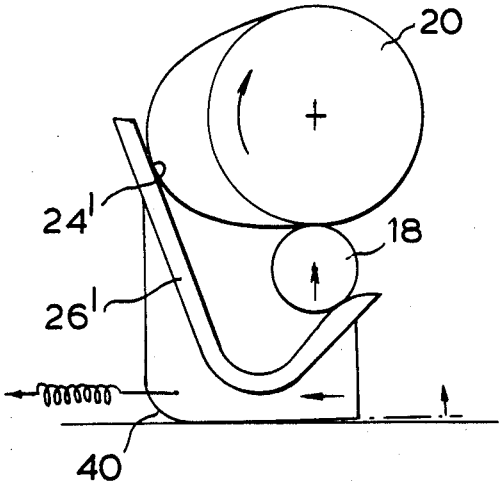
Figure 6:
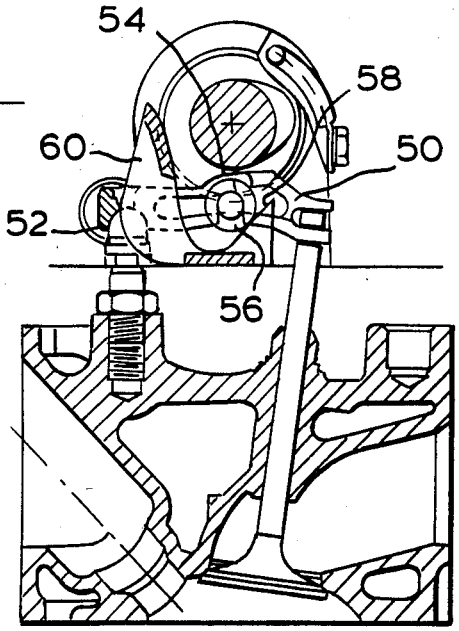

The invention will now be described further, by way of example, with reference to the accompanying drawings, in which:

FIG. 1 is a schematic view of a first embodiment of the invention shown with the valve in a closed position, FIG. 2 is a view of the same embodiment as shown FIG. 1 with the valve in an open position, FIG. 3 is a schematic view of a second embodiment shown with the valve about to begin to open, FIG. 4 is a view of the same embodiment as shown in FIG. 3 with the valve fully open, FIG. 5 shows the embodiment of FIGS. 3 and 4 when the valve is fully closed, and FIG. 6 is a perspective view of a further embodiment of the invention.

In FIG. 1, there is shown a valve 10 which is connected by means of a collet arrangement generally designated 12 to a guide 14. The guide 14 is connected to a fork 16, of which only one limb is shown, carrying a cam follower roller 18 at its upper end. The engine cam shaft is designated 20 and has an opening profile 22 which acts on the cam follower roller 18 in a direction to open the valve.

In order to close the valve, the same profile 22 acts on a profile 24 of a closing member in the form of a pivoted stirrup 26. The stirrup 26 has a second cam profile 28 which engages the cam follower 18. A light spring 30 is provided to urge the stirrup member 26 in a direction to close the valve.

As shown in FIG. 2, when the valve is fully opened, the cam follower roller 18 is arranged between the peak 20 of the cam lobe and a surface 32 on the stirrup member 26 which limits the amount of opening movement of the valve. With continued rotation of the cam 20 in the direction of the arrow shown, the opening profile 22 of the cam 20 acts on the surface 24 of the stirrup 26 to rotate the latter clockwise. This movement results in the surface 28 of the stirrup 26 acting on the cam follower 18 to raise the valve 10, the cam follower 18 being closely retained between the closing profile 34 of the cam 20 and the surface 28.

Consequently, the cam follower roller 18 is positively guided both in a opening and in a closing direction without the need for a strong valve spring to ensure that the valve remains closed. After the valve has been fully closed, the spring 30 exerts a slight pressure on the stirrup member 26 to maintain the valve closed but at such time the pressure within the cylinder will be high and will act on the surface of the valve to ensure that the valve remains tightly closed without the need for a spring to exert excessive contact pressure between the valve and the seat.

The embodiment of FIGS. 3, 4 and 5 is essentially similar in principle to that employing the pivoted stirrup but instead a slidable closing member 26' is employed having a first profile surface 24' and a second profile surface 28'. It is believed that the operation of this embodiment will be clear without the need for detailed explanation.

The advantage offered by this embodiment may be appreciated from FIG. 5. The member 26' is guided for sliding motion and it is inevitable that the guide surfaces will allow some free play of the closing member 26'. As earlier stated it is important to ensure at all times that the cam follower 18 should be retained both from below and from above without excessive clearance. If there is excessive clearance then damage can occur through the valve bouncing whereas if there is inadequate clearance the mechanism will evenutally wear and jam. The fact that the slidable closing member has a curved lower edge 40 and has free play within its guides enables the slide member to pivot slightly about its lower edge (see FIG. 5), so as to take up any clearance between the cam follower roller 18 and the two adjacent cam surfaces without exerting force on the roller to jam the mechanism.

In the embodiment shown in FIG. 6, the cam follower is in the form of a lever 50 pivoted at one end about a ball joint 52 and connected at its other end to the end of the valve stem. The upper edge of the lever 50 is provided with a cam follower surface 54 and it carries a roller 56 engageable with the profiled surface 58 on the closing member which is designated 60.

In this embodiment, the cam follower surface 54 can be shaped in a suitable manner to ensure that the valve lift diagram can be adapted to the desired shape without the need for hollow cams, which are difficult to produce.

The embodiment of FIG. 6 may be modified by replacing the closing member 60 by one mounted on the cylinder head at its lower end in a manner to allow it to rock and having at its upper end a generally V-shaped profile similar to that shown for the member 60 in FIG. 6. This makes for a more compact construction and simplifies adjustment. The lower end may be formed with a semi-cylindrical surface rocking on a post of the same or smaller radius mounted on the cylinder head in any suitable manner.

What is claimed is:

1. A valve operating mechanism for an internal combustion engine having a valve with a valve stem, a cam follower on the valve stem, and a cam shaft, all axially aligned with one another, comprising, the cam having a cam lobe thereon rotatable in synchronism with the engine crankshaft, the upper side of the cam follower being directly engagable by the cam lobe during one part of its rotation to move the valve stem and valve axially in an opening direction and disengagable from the cam lobe at other times to permit closing of the valve, and a movable one piece valve closing member contiguous to the under side of the cam follower and having a cam type projection spaced therefrom engagable by the cam lobe during another part of its rotation for moving the closing member in a direction to move the cam follower to close the valve, the closing member having an overall hook-like form with a V-shaped lower end surface engaging the underside of the cam follower, the projection being formed on a median portion of the hook-like member, the closing member being moved laterally by the cam follower upon engagement of the follower by the cam lobe forcing movement of the cam follower along the V surface towards its apex to effect a direct vertical camming of the valve to an open position by the cam lobe through the cam follower.

2. A valve operating mechanism as claimed in claim 1, wherein the closing member is slidable relative to the camshaft.

3. A valve operating mechanism as claimed in claim 2, wherein a light spring is provided to move the closing member in a direction to close the valve.

4. A valve operating mechanism as claimed in claim 1, wherein the cam follower comprises a roller mounted in line with the valve stem.

* * * * *